United States Patent [19]

Krenzel

[11] Patent Number: 4,762,211

[45] Date of Patent: Aug. 9, 1988

[54] SOFT SIDED LUGGAGE FRAME

[75] Inventor: Ronald L. Krenzel, Boulder, Colo.

[73] Assignee: Delsey Luggage Company, Jessup, Md.

[21] Appl. No.: 22,651

[22] Filed: Mar. 6, 1987

[51] Int. Cl.[4] ..... A45C 3/00; A45C 13/04

[52] U.S. Cl. ..... 190/122; 190/127

[58] Field of Search ..... 190/100, 113, 119, 120, 190/122, 123, 124, 127, 24

[56] References Cited

U.S. PATENT DOCUMENTS

| | | | |
|---|---|---|---|
| 2,684,135 | 7/1954 | Cart | 190/113 |
| 2,716,473 | 8/1955 | Droutman | 190/127 X |
| 3,029,915 | 4/1962 | Axtell | 190/121 X |
| 3,099,043 | 7/1963 | Held, Jr. | 18/19 |
| 3,513,951 | 5/1970 | Leong et al. | 190/122 X |
| 3,933,229 | 1/1976 | Pelavin | 190/111 X |
| 4,004,664 | 1/1977 | Pelavin et al. | 190/127 |
| 4,418,804 | 12/1983 | Bradley et al. | 190/127 |
| 4,550,813 | 11/1985 | Browning | 190/127 X |
| 4,589,530 | 5/1986 | Sher | 190/127 X |
| 4,598,802 | 7/1986 | Abenaim | 190/107 |
| 4,610,333 | 9/1986 | Seynhaeve | 190/122 X |

FOREIGN PATENT DOCUMENTS

| | | | |
|---|---|---|---|
| 519374 | 4/1955 | Belgium | 190/113 |

*Primary Examiner*—William Price
*Assistant Examiner*—Sue A. Weaver
*Attorney, Agent, or Firm*—Finnegan, Henderson, Farabow, Garrett & Dunner

[57] ABSTRACT

A method of manufacturing soft-sided luggage comprising the steps of forming in one piece an elongated plastic member having a U-shaped longitudinal cross section, transversely cutting from the member two frame elements of substantially identical, predetermined length, each frame element having a longitudinal U-shaped cross section including a base and two spaced, generally parallel legs, interconnecting the frame elements in opposed relationship by joining each opposed pair of legs with a one-piece resilient plastic wall element to form a generally rectangular hollow peripheral shell having two opposed open sides, and covering the shell with a flexible material including means for selectively obtaining access through at least one open side to the hollow interior of the shell.

6 Claims, 2 Drawing Sheets

SOFT SIDED LUGGAGE FRAME

BACKGROUND OF THE INVENTION

1. Field of the Invention

This invention relates to soft-sided luggage frames and a method of manufacturing such frames.

2. Description of Related Art

Existing soft-sided luggage frames are made of steel, aluminum, plastic extrusions or combinations thereof, the components of which must be individually manufactured for one frame at a time. Most such frames comprise multiple independent components which must be assembled. Manufacturing of the components and the assembly substantially increases the manufacturing cost.

An example of a soft-side luggage frame is presented in Bradley et al., U.S. Pat. No. 4,418,804, where the frame includes a plastic element defining the bottom and bottom corners and an aluminum element secured to the bottom element in defining the top and sides of the frame.

One-piece soft-side frames are known, such as the injection molded plastic frame sold by Delsey Luggage, Inc. and identified as the Helium frame. This frame has the disadvantage of being very costly because of the costs of the high strength precision tooling for injection molding. Wood and cardboard frames are also known but are subject to breakage and cannot be adapted to receive handles, locks, wheels and other accessories.

Those soft-side suitcase frames which are made of the same materials at the sides and top, such as that in Bradley et al. and the Delsey Helium frame, must compromise between the flexibility needed to recover from shocks and pressure and the rigidity needed to support the shape of the luggage at the top and bottom when the case is carried under a load or is rolled when equipped with wheels. Pelavin et al., U.S. Pat. No. 4,004,664, teaches a frame construction using the same material throughout but which includes articulated metal plates and springs to allow shock and pressure recovery flexibility. The structure of the device in Pelavin et al. is expensive and labor intensive to manufacture.

A particular difficulty of soft-side luggage frames is the necessity to provide a smooth rim which will give shape to the corners and around which the opening may be easily zipped shut. If the soft exterior of the case is snugly fitted to a full width frame, the zipper will catch on the edge of the frame. Where frames are not full width, the corners are supported most often with a separate corner reinforcement of flexible plastic as taught in Bradley et al., but even this solution results in resistance to the closing of the zipper.

The subject invention overcomes the disadvantages of the prior art by providing an economical method of manufacturing soft-sided luggage frames and by providing a frame having the required rigidity and the needed flexibility.

SUMMARY OF THE INVENTION

The objects and advantages of the invention may be realized and obtained by means of the instrumentalities and combinations particularly pointed out in the appended claims.

In accordance with the invention, as embodied and broadly described herein, a method of manufacturing soft-side luggage comprises the steps of vacuum molding in one-piece an elongated, plastic member having a U-shaped transverse cross section; transversely cutting from the member two frame elements of substantially identical, predetermined length, each frame element having a longitudinal U-shaped cross section including a base and two spaced, generally parallel legs; interconnecting the frame elements in opposed relationship by joining each opposed pair of legs with a one-piece resilient plastic wall element to form a generally rectangular, hollow, peripheral shell having two opposed open sides; and covering the shell with a flexible material including means for selectively obtaining access through at least one open side to the hollow interior of the shell.

While the two frame elements defining the top and bottom of the luggage frame may be identical, it may be preferred to vacuum mold in one piece an elongated plastic top member having a U-shaped transverse cross section and to vacuum mold in one piece an elongated plastic bottom member having a U-shaped transverse section and then transversely cutting from each of the top and bottom members a top frame element and a bottom frame element, respectively, and interconnecting the top and bottom frame elements in opposed relationship by joining each opposed pair of legs with a one-piece resilient plastic wall element to form a generally rectangular, hollow peripheral shell having two opposed open sides.

Preferably, the plastic members are molded with a repeating pattern of transversely-extending, spaced, parallel reinforcing ribs and the frame elements are cut from the member between adjacent rib patterns.

In a preferred embodiment, the top and bottom members are molded in a plurality of longitudinally-connected, substantially identical segments of predetermined length, each segment having a shallow, generally U-shaped transverse cross section, and the frame elements are obtained by transversely cutting the members at the connection between adjacent segments.

In accordance with the invention, a frame for soft-sided luggage comprises top and bottom vacuum molded plastic frame elements, each frame element having substantially identical length and having a generally U-shaped longitudinal cross section including a base and spaced, parallel legs, the frame elements being disposed in opposed relationship, and a resilient wall element joining each pair of opposed legs of the frame elements to define a generally rectangular hollow peripheral shell, the wall elements having a width generally equal to the frame elements and being corrugated in a direction perpendicular to the width.

BRIEF DESCRIPTION OF THE DRAWINGS

The accompanying drawings, which are incorporated in and constitute a part of the specification, illustrate embodiments of the invention, and together with the description, serve to explain the principles of the invention.

DETAILED DESCRIPTION OF THE PREFERRED EMBODIMENTS

Reference will now be made in detail to the present preferred embodiments of the invention, examples of which are illustrated in the accompanying drawings.

Figure 1:
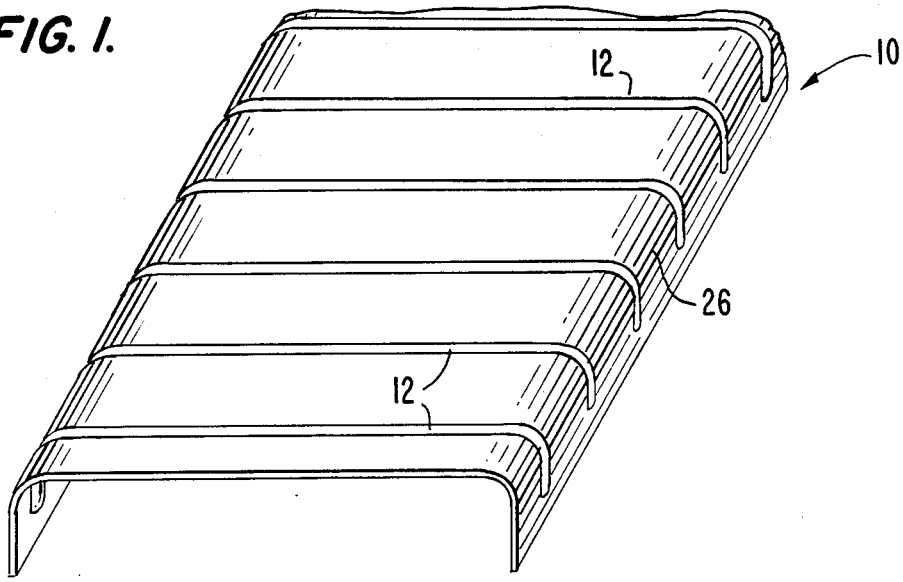
FIG. 1 is a perspective view of a vacuum molded plastic member manufactured in accordance with the invention.

The method of the invention comprises forming in one piece an elongated, plastic member having a U-shaped transverse cross section. As depicted in FIG. 1, elongated, plastic member 10 has a U-shaped transverse cross section which is formed by vacuum molding in one piece in accordance with the invention. The vacuum molding technique of the invention is known and is shown in, for example, Leong et al., U.S. Pat. No. 3,513,951 and Held, Jr., U.S. Pat. No. 3,099,043. Other heat forming methods such as pressure molding or injection techniques may be used in some circumstances.

Preferably, plastic member 10 is molded with a plurality of transversely extending, spaced, parallel reinforcing ribs 12.

Figure 3:
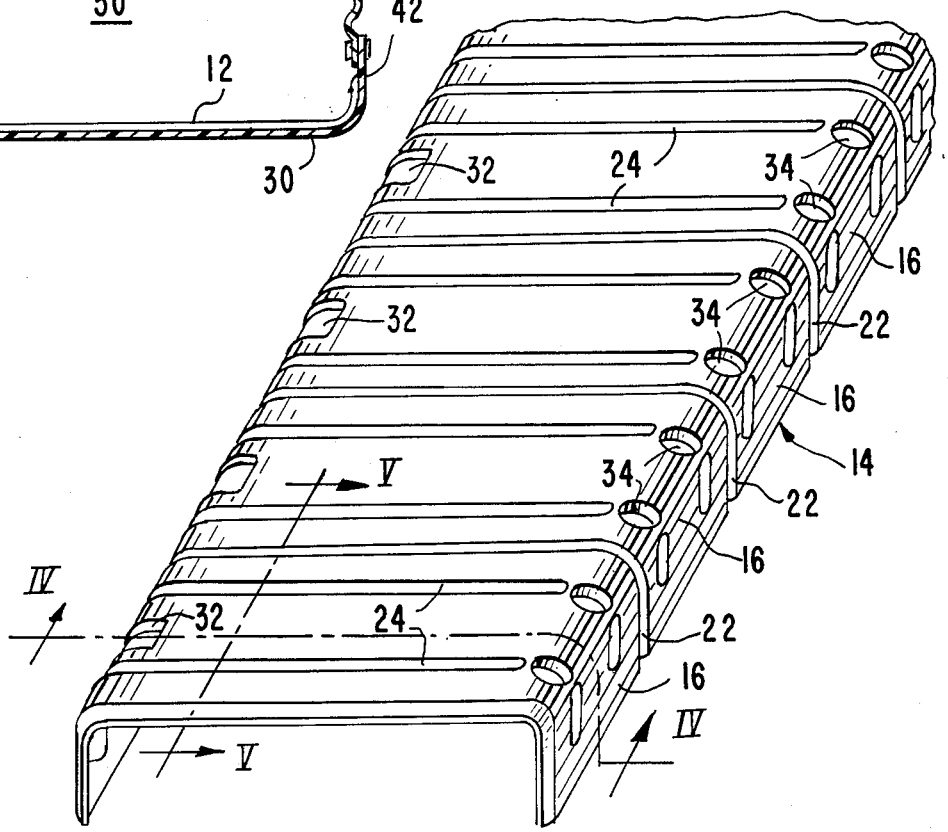
FIG. 3 is a perspective view of an alternative embodiment of a vacuum molded plastic bottom member manufactured in accordance with the invention.
Figure 5:
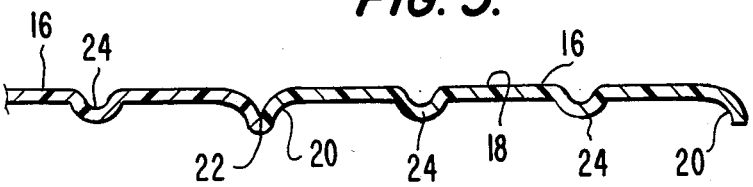
FIG. 5 is an enlarged cross-sectional view taken along lines V—V in FIG. 3.

In a preferred embodiment, as depicted in FIG. 3, plastic member 14 is molded in a plurality of longitudinally connected substantially identical segments 16. As seen in FIG. 5, each segment 16 has a shallow, generally U-shaped transverse cross section. Alternatively, the segments 16 may be described as including a longitudinal planar portion 18 and rounded transverse edges 20. Segments 16 when molded in member 14 are interconnected at a juncture 22.

In the embodiment depicted in FIG. 3, each segment is preferably molded to include longitudinally extending transversely spaced parallel reinforcing ribs 24.

Figure 2:
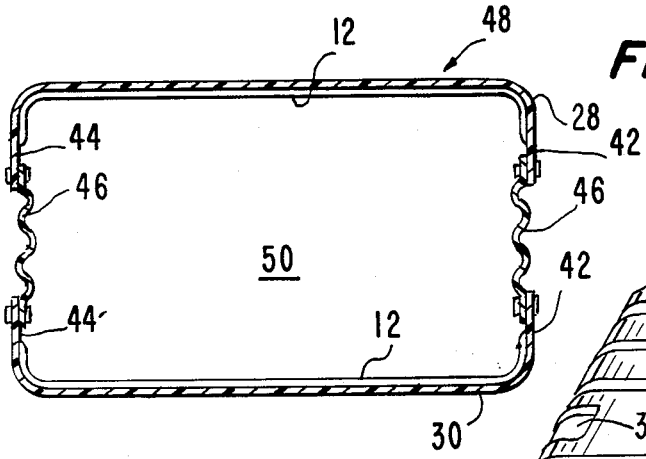
FIG. 2 is a cross-sectional plan view of a luggage frame manufactured using two frame elements from the member of FIG. 1.

The method of the invention further includes the step of transversely cutting from the member two frame elements of substantially identical, predetermined length, each frame element having a longitudinal U-shaped cross section including a base and two spaced generally parallel legs. As seen in FIGS. 1 and 2, member 10 is transversely cut in spaces 26 between adjacent ribs 12. Where the frame is to have identical top and bottom frame elements, two elements are cut from the same member 10. Thus, as seen in FIG. 2, top frame element 28 and bottom frame element 30 are identical having the same predetermined length.

In a preferred embodiment, a one-piece elongated plastic top member, such as member 10 in FIG. 1, having a U-shaped transverse cross section including a base and spaced generally parallel legs is vacuum molded and a one-piece elongated plastic bottom member, member 14 in FIG. 3, having a U-shaped transverse cross section including a base and spaced, generally parallel legs is separately vacuum molded.

Figure 4:
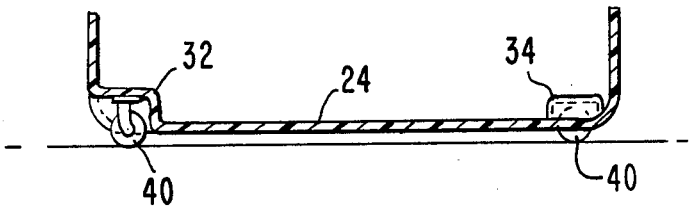
FIG. 4 is an enlarged partial cross-sectional view taken along lines IV—IV of FIG. 3 with a wheel attached to the bottom member.

In the preferred embodiment, the top member is molded to include a repeating pattern of transversely extending spaced parallel reinforcing ribs 12. The bottom member is vacuum molded to include a repeating pattern of transversely spaced recesses 32, 34. Recesses 32, 34 are disposed in the frame elements in bottom member 14 to accommodate placement of wheels 40, as depicted in FIG. 4. The bottom member may also include a repeating pattern of reinfocing ribs 24. The repeating patterns of features in the top and bottom members are so disposed as to permit transversely cutting a top frame element of a predetermined length from the top member and a bottom frame element of the same predetermined length from the bottom member. The top and bottom frame elements will each include at least one of the respective rib and recess patterns.

In the embodiment as depicted in FIGS. 3 and 5 where the member is comprised of a plurality of interconnected segments each having a shallow U-shaped transverse cross section, the frame elements from such member are cut along connection 22 between adjacent segment 16.

In accordance with the invention, the method includes the step of interconnecting the frame elements in opposed relationship by joining each opposed pair of legs with a one-piece resilient plastic wall element to form a generally rectangular, hollow peripheral shell having two opposed open sides. As seen in FIG. 2, identical frame elements 28 and 30, cut from the member 10 in FIG. 1, are disposed in opposed relationship. Opposed pairs of legs 42, 44 are joined by one-piece resilient plastic wall elements 46 to form a generally rectangular, hollow peripheral shell 48 having two opposed open sides 50. In the embodiment wherein separate top and bottom frame elements are cut from different members, their assembly into a completed frame is the same as that depicted in FIG. 2 wherein resilient plastic wall elements 46 are affixed between the opposed legs of the top and bottom frame elements. Any known manner of fixing plastic wall elements 46 to plastic frame elements 28, 30 may be used, such as rivets or adhesive.

Figure 6:
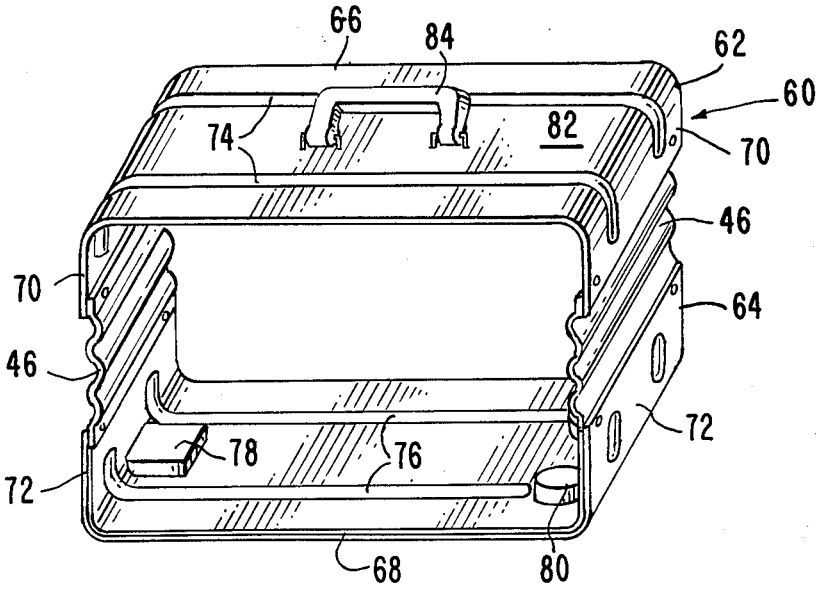
FIG. 6 is a perspective view of a luggage frame of the invention.

While the frame elements 28, 30 cut from members 10, 14 are formed of semi-rigid plastic, wall elements 46 are preferably designed to be resilient in order to absorb shocks without causing structural failure of the frame. As depicted in FIGS. 2 and 6, the wall elements 46 are corrugated to enhance the spring-like function of the wall elements.

In accordance with the invention, the method of manufacturing further includes the steps of covering the shell with flexible material including means for selectively obtaining access through at least one open side to the hollow interior of the shell, and may include operatively mounting wheels in recesses in a bottom frame element. The step of covering the shell with flexible material is known and the means for obtaining access is also known. Examples of both are depicted in Pelavin et al., and Bradley et al., discussed above. Incorporation of wheels in the bottom element is also known, as seen in Bradley et al., and as depicted, in part, in FIG. 4 hereof.

In accordance with the invention, a frame for soft-sided luggage comprises top and bottom vacuum molded plastic frame elements, each frame element having substantially identical length and having a generally U-shaped longitudinal cross section including a base and spaced parallel legs, the frame elements being disposed in opposed relationship. As depicted in FIG. 6, frame 60 includes top and bottom vacuum plastic frame elements 62,64, respectively, each element 62, 64 having substantially identical length and having a generally U-shaped longitudinal cross section including a base 66, 68 and spaced parallel legs 70,72. Frame elements 62, 64 are disposed in opposed relationship.

In accordance with the invention, the frame comprises a resilient wall element joining each pair of opposed legs of the frame elements to define a generally rectangular, hollow peripheral shell, the wall elements having a width generally equal to the frame elements and being corrugated in a direction perpendicular to the width. As seen in FIG. 6, resilient wall elements 46 join each pair of opposed legs 70, 72 of frame elements 62, 64 to define a generally rectangular, hollow, peripheral shell. Wall elements 46 have a width generally equal to the frame elements and are corrugated in a direction perpendicular to the width. Where the frame elements are molded to have shallow, U-shaped, transverse cross sections, each element includes a longitudinal planar portion 18 and rounded transverse edges 20, as depicted in FIG. 5. In that embodiment, wall elements 46 and planar portions 18 of frame elements 62, 64 are longitudinally coextensive as depicted in FIG. 6.

Preferably, each frame element 62, 64 includes integrally-formed, longitudinally extending, transversely-spaced, parallel reinforcing ribs 74, 76.

In a preferred embodiment, the bottom frame element 64 includes integrally-formed, longitudinally-spaced recesses 78, 80 open to the outside of the U-shaped bottom frame element, at least one recess being disposed in the base of the bottom frame element proximate each leg thereof. Wheels 40, as depicted in FIG. 4, are operatively mounted in each recess 78, 80.

Preferably one longitudinal space 82 between adjacent ribs 74 in top frame element 62 is centrally located and has a length sufficient to permit attachment of a handle 84 thereto.

Additional advantages and modifications will readily occur to those skilled in the art. The invention in its broader aspects is, therefore, not limited to the specific details, representative apparatus and illustrative example shown and described. Accordingly, departures may be made from such details without departing from the spirit or scope of the general inventive concept as defined by the appended claims and their equivalents.

What is claimed is:

1. A frame for soft-sided luggage comprising:

top and bottom plastic frame elements, each said frame element having substantially identical length and having a generally U-shaped longitudinal cross section including a base and spaced parallel legs, said frame elements being disposed in opposed relationship; and a resilient wall element joining each pair of opposed legs of said frame elements to define a generally rectangular hollow peripheral shell, said wall elements having a width generally equal to the width of said frame elements and being corrugated in a direction perpendicular to said width of said wall elements.

2. The frame of claim 1 wherein each said frame element includes a longitudinal planar portion and rounded transverse edges and wherein said wall elements and the planar portions of said frame elements are longitudinally coextensive.

3. The frame of claim 1 wherein each said frame element includes integrally-formed, longitudinally-extending, transversely-spaced, parallel reinforcing ribs.

4. The frame of claim 1 wherein said bottom frame element includes integrally-formed, longitudinally-spaced recesses open to the outside of said U-shaped bottom frame element, at least one said recess being disposed in the base of said bottom frame element proximate each leg thereof.

5. The frame of claim 4 wherein a wheel is operatively mounted in each said recess.

6. The frame of claim 3 wherein one longitudinal space between adjacent ribs in said top frame element is centrally located and has a length sufficient to permit attachment of a handle thereto.

* * * * *